US005913604A

United States Patent [19]

Brouwer et al.

[11] Patent Number: 5,913,604

[45] Date of Patent: Jun. 22, 1999

[54] DREDGING INSTALLATION

[75] Inventors: Jan Brouwer, Pijnacker; Hendrikus Van Berk, Bunnik, both of Netherlands

[73] Assignees: De Groot Nijkerk Maschinefabriek B.V., Nijkerk; B & B Beheer B.V., Pijnacker; Aannemingsbedrijf J.G. Nelis B.V., Haarlem, all of Netherlands

[21] Appl. No.: 08/737,579

[22] PCT Filed: May 16, 1995

[86] PCT No.: PCT/NL95/00174

§ 371 Date: Dec. 3, 1996

§ 102(e) Date: Dec. 3, 1996

[87] PCT Pub. No.: WO95/31613

PCT Pub. Date: Nov. 23, 1995

[30] Foreign Application Priority Data

May 16, 1994 [NL] Netherlands ..... 9400797

[51] Int. Cl.[6] ..... E02B 3/02

[52] U.S. Cl. ..... 37/335; 37/307

[58] Field of Search ..... 37/195, 317, 318, 37/319, 320, 321, 323, 334, 335, 308, 309; 210/122, 242.3, 923; 299/13, 18

[56] References Cited

U.S. PATENT DOCUMENTS

| | | | |
|---|---|---|---|
| 925,079 | 6/1909 | Carlesimo | 37/317 |
| 3,909,960 | 10/1975 | Casciano . | |
| 3,969,834 | 7/1976 | Geier et al. | 37/321 |
| 4,030,216 | 6/1977 | Willums . | |
| 4,373,276 | 2/1983 | Schnell | 37/335 X |
| 4,914,841 | 4/1990 | Weimris | 37/195 |
| 4,995,175 | 2/1991 | Winter | 37/309 X |
| 5,083,386 | 1/1992 | Sloan | 37/318 X |
| 5,129,167 | 7/1992 | Nakahara | 37/318 |

FOREIGN PATENT DOCUMENTS

| | | |
|---|---|---|
| 58-153827 | 9/1983 | Japan . |
| 8104791 | 5/1983 | Netherlands . |

*Primary Examiner*—Terry Lee Melius
*Assistant Examiner*—Robert Pezzuto
*Attorney, Agent, or Firm*—Young & Thompson

[57] ABSTRACT

An installation for sucking up material from the bed of a body of water includes a housing (1) that is provided with a suction pipe (2) which extends toward the bed of the body of water and that has a suction opening (22) and is connected to a pump (4) located in the housing (1). The suction opening can be selectively spaced at various distances from the housing by relative movement of sections of the suction pipe.

21 Claims, 4 Drawing Sheets

DREDGING INSTALLATION

The invention relates to an installation for sucking up material located on the bed of a body of water, comprising a housing that is provided with a suction pipe which extends towards the bed of the body of water, which suction pipe has a suction opening and is connected to a pump located in the housing, as well as means for removal of the material sucked up.

An installation of this type is disclosed in NL-A8104791. Said known installation can be sunk in the body of water, so that the suction pipe can be positioned accurately with respect to the bed away from the effect of the waves and the correct suction action can always be ensured.

The suction pipe is hingeably fixed at its upper end to the housing in such a way that the draught of the installation can be adjusted to the depth of the water.

When the installation is in operation, a sand/water mixture is sucked up via the suction opening in the suction pipe. During this operation a hollow or breach is gradually formed in the bed, into which sand flows from the surroundings. After some time this hollow-producing or breaching process can come to a halt because the walls of the hollow become too flat and no further inflow takes place. As a consequence thereof, either the suction pipe or the entire installation must be moved in such a way that the breaching process can be repeated from the start in a different location.

The disadvantage of this procedure is the loss of time which it entails. Specifically, suction has to be interrupted during the movement of the suction pipe or of the entire installation, as a result of which the production is at a standstill. Furthermore, in order to move the suction pipe alone, said pipe must be rotated about its hinge point. This disturbs the equilibrium of the entire installation; the equilibrium must then be restored by means of trimming means.

As an alternative it would be possible to adjust the height of the entire installation with respect to the bed. However, an adjustment of this type is not simple to carry out with the desired accuracy. The consequence can be that the installation floats up, as a result of which the suction process is interrupted.

The aim of the invention is, therefore, to provide an installation of the type described above with which the suction process can be better controlled. Said aim is achieved in that the suction pipe protrudes at a fixed angle with respect to the housing and in that the suction opening has a variable position with respect to the housing and/or the suction pipe.

The installation according to the invention can be supported very well on the suction pipe which runs at a fixed angle with respect to the housing. In fact, said suction pipe also acts as a supporting leg, by means of which the installation can be firmly fixed in the bed.

A further advantage of the installation according to the invention is that the fixed suction pipe is able to form a hollow very much more rapidly than the suction pipe of variable angular position in accordance with the prior art. This is because the suction pipe of variable angular position is initially at a slope, in which position it produces a less efficient spraying process because the direction of spraying is then likewise directed at an angle over the bed to be treated. The fixed suction pipe can penetrate relatively rapidly into the bed, as a consequence of which the installation according to the invention is anchored well straight away. As a result, the installation according to the invention suffers few problems due to swell.

Furthermore, the end of the suction pipe remote from the housing can be provided with a supporting face and a suction opening can be located in at least two positions, said positions being different distances away from the supporting face. By virtue of the variable level of the suction opening, the entire installation does not have to be raised or lowered if the dredging conditions indicate that this is required, for example if insufficient sand flows in. The breaching process can now be controlled in a simple manner, which is beneficial for production and improves the reliability of the installation.

The suction pipe plus supporting leg can be produced in various ways. According to a first possibility, that part of the suction pipe which contains the suction opening is slidable in its longitudinal direction with respect to the housing. In this embodiment, the installation can also be used in shallow water by retracting the suction pipe. A further advantage is that the distance from the installation to the shore or bank can be minimised, so that the distance over which the material sucked up has to be conveyed, and consequently the installed capacity, can be restricted.

By virtue of the small draught, the installation can also be towed to harbours where the depth of water is restricted. Despite the manipulations with the suction pipe, the stability of the installation is maintained, in view of the fixed angular position of the suction pipe with respect to the housing.

In this context, the suction pipe can consist of two telescopic suction pipe sections, the upper suction pipe section of which is fixed with respect to the housing.

In a preferred embodiment of the invention, a jacket pipe which encloses the suction pipe and is slidable with respect to the housing is provided in which the lower telescopic suction pipe section is fixed. Said jacket pipe imparts the necessary rigidity and strength to the suction pipe and at the same time forms a protective cover for said pipe.

Preferably, guide means are provided for guiding the lower telescopic suction pipe section with respect to the upper suction pipe section in such a way that said suction pipe sections are movable between a non-overlapping position in which they are some distance apart in their longitudinal direction, exposing an opening between the two ends of the pipe sections which face each other, and an overlapping position in which the pipe sections are slid over one another.

As soon as the telescopic pipe sections have been brought into the non-overlapping position, the suction effect of the installation takes place primarily via the opening which is then formed. Said opening is located at a higher level than the opening at the bottom of the lower telescopic section. The advantage of this movement of the suction effect to an opening located higher is that the operation can be better matched to the rate at which the material to be sucked up, for example sand, flows towards the suction openings.

The suction pipe can, for example, have penetrated so deeply into the bed during suction operation via the lower opening that the bottom of the housing comes to rest on the bed. Problems with regard to the flow of material to the lower opening can arise as a result of this. By now manipulating the telescopic suction pipe sections in such a way that the abovementioned higher opening is produced, it is also possible to suck away the higher bed material on which the housing is resting. The suction pipe is thus able to penetrate deeper into the bed, as a result of which it is again possible to suck via the lower opening.

By retracting the lower telescopic pipe slightly from the position in which it is extended to the maximum, the upper suction opening is closed again, such that the lower suction opening can also be used when the lower pipe section is virtually fully extended.

A centering ring can be provided on the jacket pipe some distance above the end of the lower suction pipe section facing towards the upper telescopic suction pipe section, which centering ring surrounds the upper suction pipe section whatever the position into which the jacket pipe has been slid and centres the latter with respect to the lower suction pipe section. With the aid of said centering ring, the lower telescopic suction pipe section can be fed reliably back from its maximum extended position into the upper suction pipe section.

Furthermore, the lower end of the wall of the lower telescopic pipe section can be provided with at least one opening which is connected by means of a line to an opening in the wall of the jacket pipe.

The upper end of the lower telescopic suction pipe section can be fixed by means of an angular partition to the jacket pipe, and the jacket pipe can be provided with at least one opening above said partition.

According to an alternative embodiment, both the lower telescopic section and the jacket pipe can each be provided with at least one circumferential opening, which circumferential openings can be aligned. In the position in which the lower telescopic section has been retracted, in such a way that the circumferential openings in both sections are aligned, the suction effect takes place at said openings. When the telescopic section is moved outwards each circumferential opening in the upper section is closed off. As soon as the circumferential opening(s) in the lower section emerge from the upper section, the suction effect takes place at said opening(s). The height of the circumferential openings exerting suction is now lower than in the case where the circumferential openings in the two sections overlap one another; moreover, the height can be varied even further by extending the lower section to a greater or lesser extent.

According to a further variant, the lower telescopic section has two helical openings and the jacket pipe has several circumferential openings, the pitch of the helices being so chosen that whatever the position into which the lower telescopic section has been slid at least one of the helical openings thereof is always opposite at least one circumferential opening in the jacket pipe. With this embodiment the suction effect is maintained by the same circumferential openings all the time; only the total length of the suction pipe varies.

Preferably, the housing is provided with a central core in which the jacket pipe is slidably accommodated. Said central core opens onto the top surface of the housing, where it is closed off by means of a removable lid. After the lid has been removed, the jacket pipe, together with the pipe sections accommodated therein, can be removed from the housing from the top. The advantage thereof is that any maintenance on said components is facilitated, as this does not have to be carried out underwater or with the entire installation hoisted up.

According to a further possible embodiment, the suction pipe has at least two suction openings located some distance apart in the longitudinal direction, which suction openings are each provided with closing means. The suction pipe can be surrounded by a fixed jacket pipe, into which the suction openings open. According to a preferred embodiment, the jacket pipe is provided with an external collar which is slidable in the longitudinal direction and is movable between positions in which it in each case exposes each suction opening in one position in the longitudinal direction of the suction pipe.

The top surface of the housing can also be conical. The conical shape is preferably so chosen that this approximates roughly to the natural slope of, for example, sand. By this means problems with regard to raising the installation from a position in which it is virtually embedded in the bed are avoided. With a top surface shaped in this way, the material which has collected on top of the housing can slide off easily, as a result of which the installation can float up again.

An illustrative embodiment of the invention will now be described in more detail with reference to the figures.

Figure 5A:
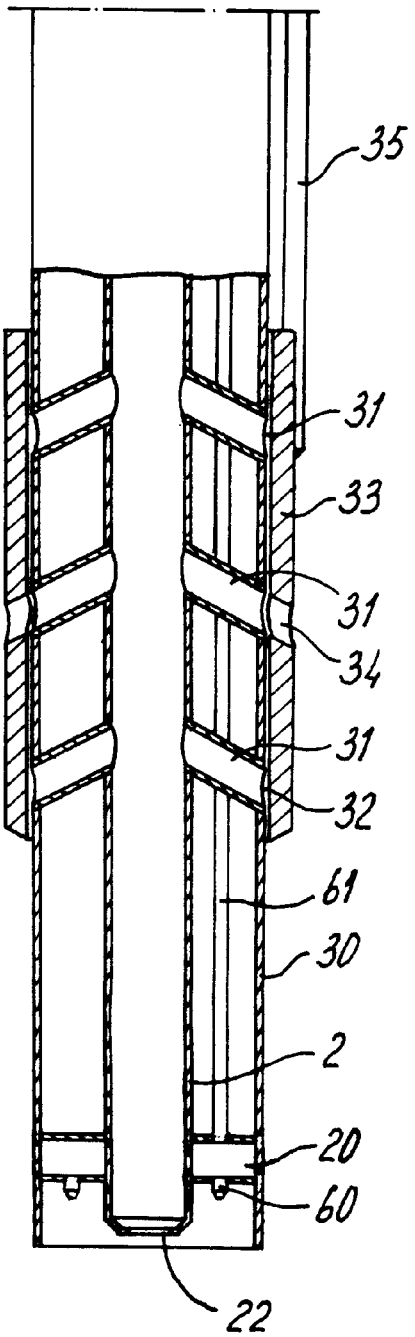
Figure 5B:
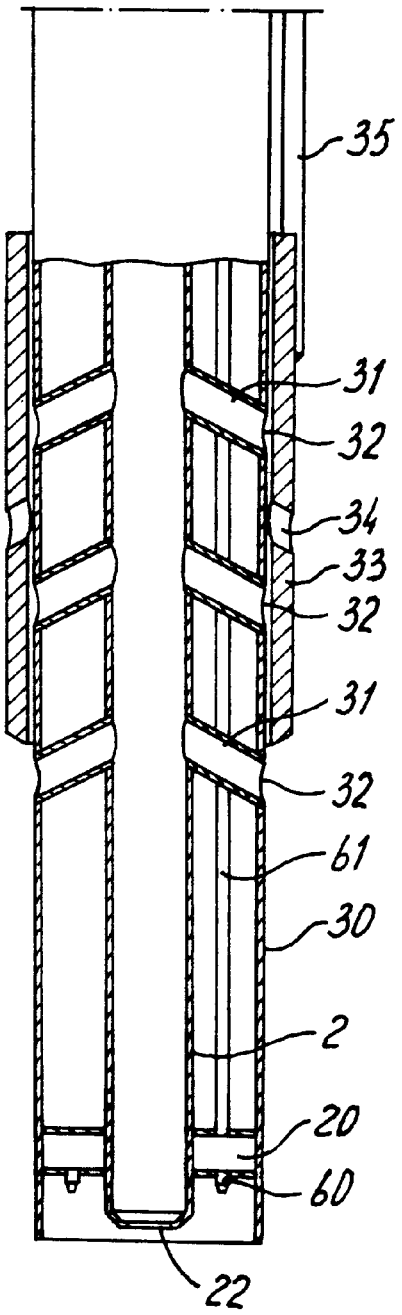

FIGS. 5*a* and 5*b* show a further embodiment of the suction pipe according to the invention.

Figure 6:
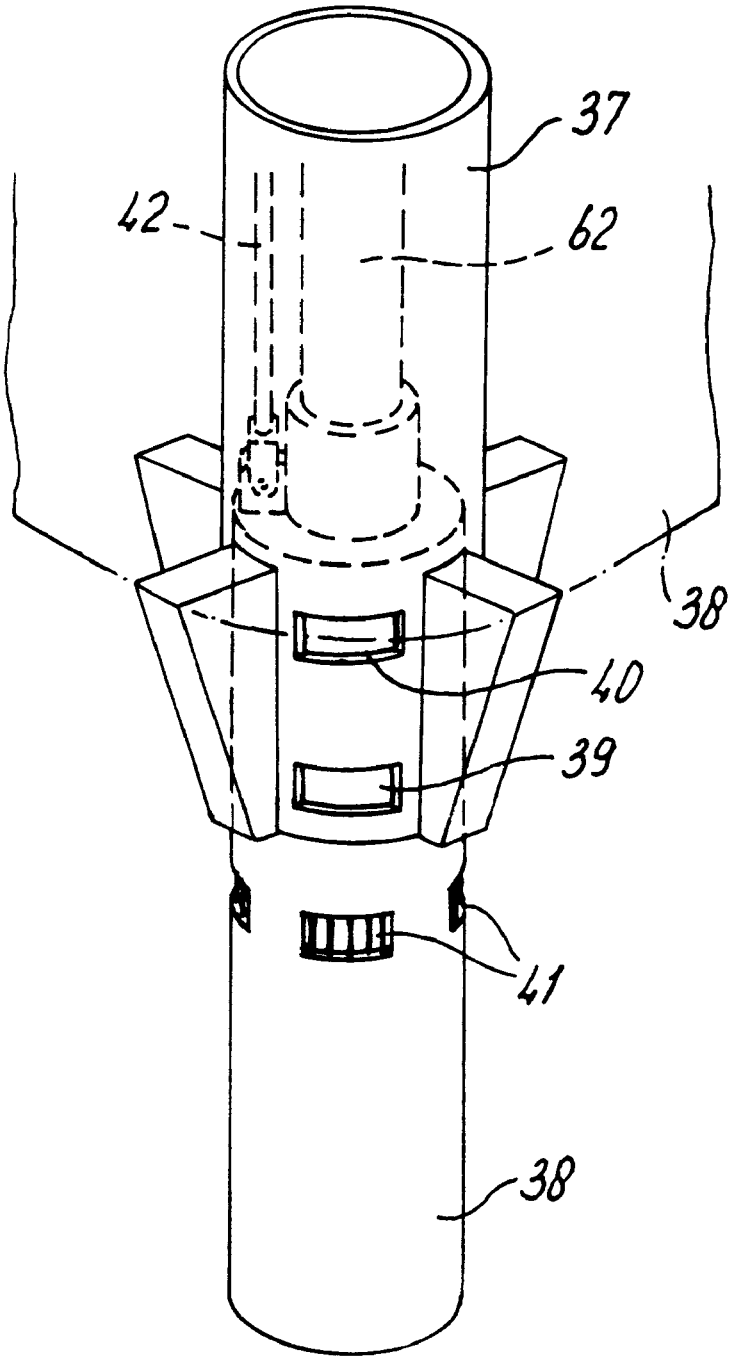

FIG. 6 shows another embodiment of the suction pipe according to the invention.

Figure 1:
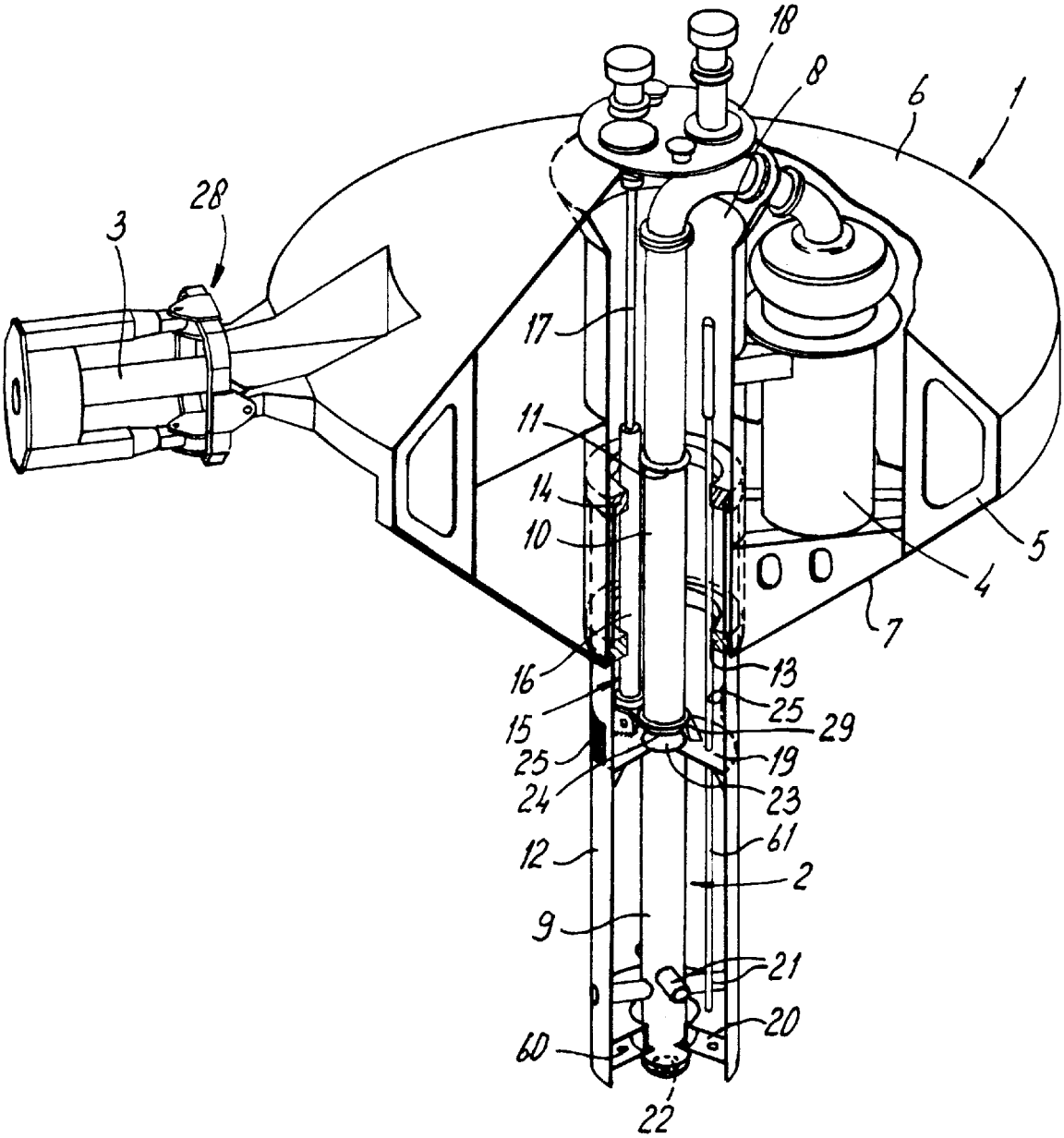
FIG. 1 shows an exposed perspective view of the installation according to the invention, with the suction pipe fully extended.

The installation according to the invention as shown in FIG. 1 comprises a housing, which is indicated in its entirety by 1, a suction pipe 2 and a discharge line 3. The suction pipe 2 is connected to a pump 4, to which the discharge line 3 is also connected. The material for dredging is sucked up in a known manner via suction pipe 2 by the action of the pump 4, by means of which said material is then forced into discharge line 3. For a more detailed description of the mode of action of this installation, reference is made to application NL-A-8104791, which has already been mentioned above.

The housing 1 has a construction in which, inter alia, radial trusses 5 are accommodated, a conically tapering top 6, and a bottom 7, which is likewise of conical construction. By virtue of the conical shape of the top, material falling thereon will not collect but will slide off. Consequently, it is always ensured that the dredging installation can be refloated. The conical shape at the bottom 7 allows good inflow of material for dredging to the suction opening.

A cylindrical core 8 is arranged centrally in the housing 1 and the suction pipe 2 runs through the middle of said core.

The suction pipe 2 is made up of a lower telescopic suction pipe section 9 and an upper telescopic suction pipe section 10. The lower telescopic suction pipe section 9 can be slid over the upper telescopic suction pipe section 10 until said lower telescopic suction pipe section 9 is in contact with the stop ring 11 fixed on the upper telescopic suction pipe section 10; see FIG. 4.

The suction pipe 2 is accommodated in a jacket pipe 12, which is movable up and down in the cylindrical core 8. To this end, the jacket pipe 12 has two support rings 13, 14, which are slidably movable with respect to said core 8. Also to this end, the housing 16 of the hydraulic piston-cylinder device 15 is fixed to the inside of the jacket pipe 12, the piston rod 17 of said piston-cylinder device 15 being fixed to the lid 18 which closes off the cylindrical core 8.

The lower telescopic: suction pipe section 9 is fixed in the jacket pipe, specifically at its top by means of partition 19, and at its bottom by means of chamber 20. Chamber 20 has injection nozzles 60 which open at the bottom and are fed via chamber 20 and line 61 with spray water for loosening the bed material. A number of suction lines 21 run between the lower telescopic suction pipe section 9 and the jacket pipe. At its bottom end, the lower telescopic suction pipe section 9 likewise has a suction opening 22.

Figure 2:
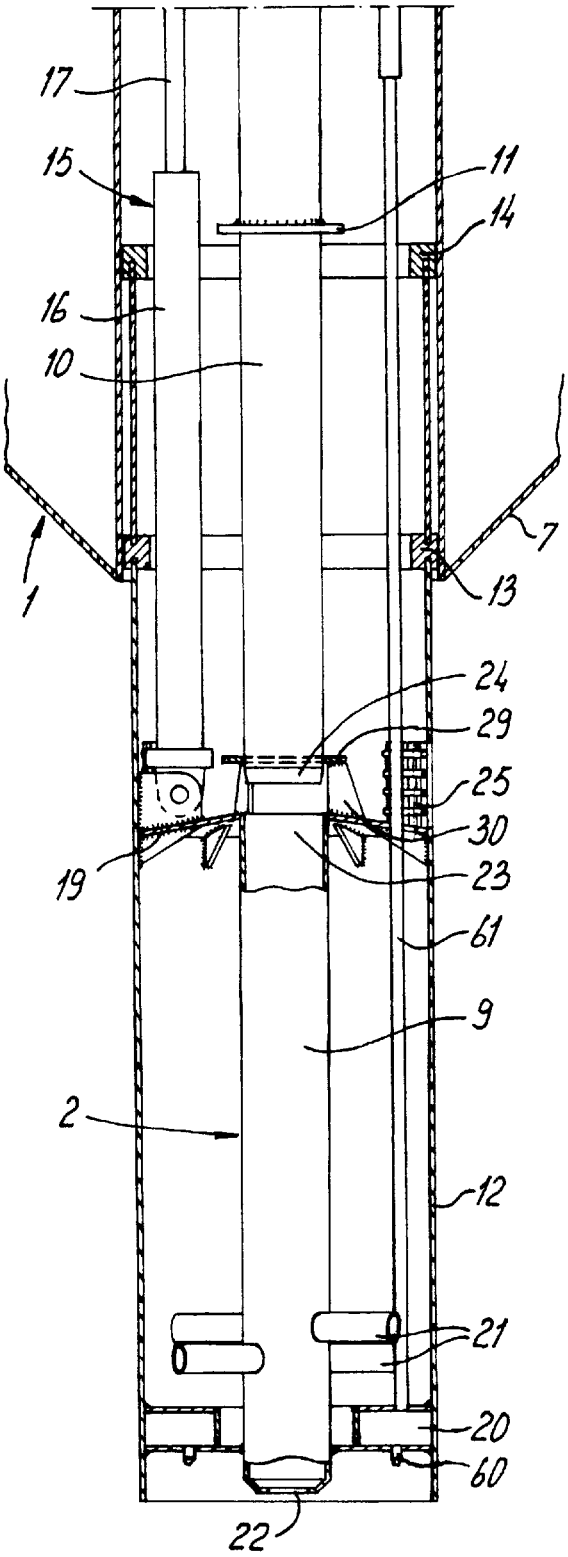
FIG. 2 shows a partial cross-section of the installation according to the invention corresponding to FIG. 1.

In the situation shown in FIGS. 1 and 2 the jacket pipe 12, and consequently the lower telescopic suction pipe section 9, is extended to the maximum. This means that the upper opening 23 of said lower telescopic suction pipe section 9 is some distance away from the opening of the lower end 24 of the upper telescopic suction pipe section 10. The suction effect of the pump 4 will consequently remain restricted to the gap above the partition 19; said gap is connected with the surroundings via the openings 25, which are provided with gratings, in the jacket pipe 12. In this position, material for dredging can be sucked up by means of the installation according to the invention, which is located just below the housing 1.

Figure 3:
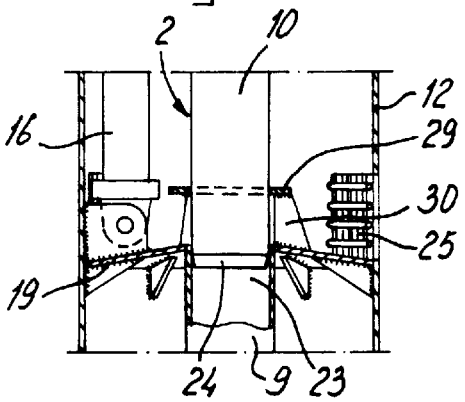
FIG. 3 shows a partial cross-section of the installation with the suction pipe in an intermediate position.

When the jacket pipe 12 is moved slightly upwards, the lower end 24 of the upper telescopic suction pipe section 10 comes to lie within the upper opening 23 of the lower telescopic suction pipe section 9, the various aspects being as shown in FIG. 3. In this position the suction effect moves from the openings 25 to the suction lines 21. This means that even material which is located a relatively large distance away from the housing 1 can be sucked up. By manipulating the jacket pipe 12, and consequently the lower telescopic section, in a suitable manner, it is possible, working upwards, to suck up specific sections of the material for dredging in succession. Consequently, the desired flow of said material to the installation can also be facilitated.

Figure 4:
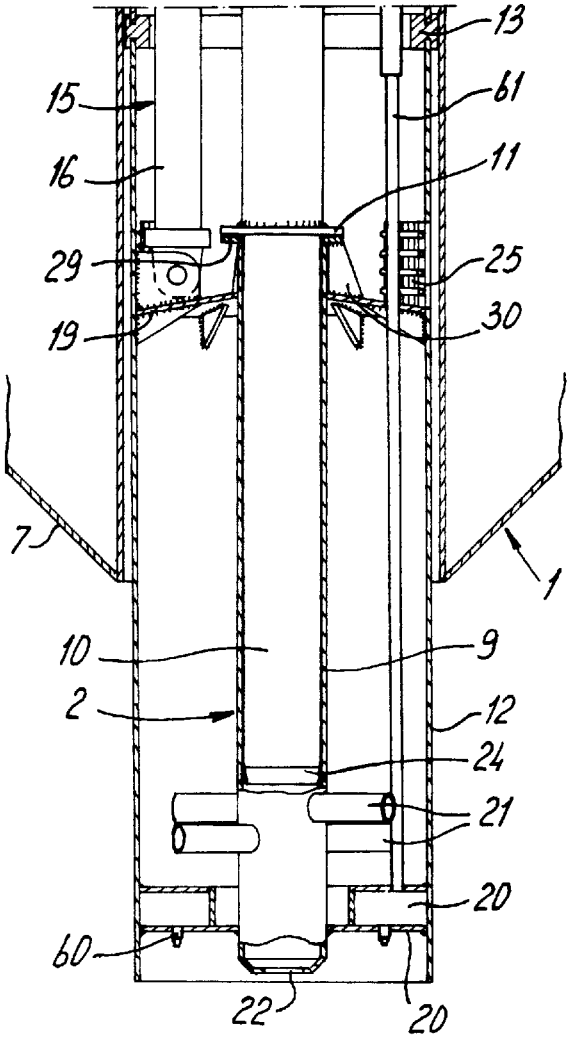
FIG. 4 shows a cross-section of the installation with the suction pipe completely retracted.

The situation shown in FIG. 4 is reached on further retraction of the piston-cylinder device 15.

The upper telescopic suction pipe 10 has disappeared into the lower telescopic suction pipe section 9 up to the stop ring 11. The suction effect is still taking place via the suction lines 21; said lines are now located at a height close to the housing 1. The jacket pipe 12 now protrudes only a small distance out of the housing 1, which means that the installation can also be used in relatively shallow water.

As can clearly be seen in FIG. 1, the top of the core 8 is closed off by lid 18. After removal of the lid and dismantling various components, the complete jacket pipe 12, together with the upper and lower telescopic suction pipe sections 10 and 9, respectively, can be lifted out of the housing 1 from the top. Consequently, maintenance and any repair of the installation is simple; the associated activities can be carried out above water.

It is also pointed out that the discharge line 3 is fixed to the housing 1 by means of universal joint 28. Consequently, line 3 can run at a number of different angles with respect to the housing 1 without any problems.

In the embodiment in FIGS. 5*a* and 5*b* , the suction pipe 2 is accommodated in a jacket pipe 30, which is fixed with respect to the housing (which incidentally is not shown). The slidable jacket pipe 30 is located in the same position with respect to the housing.1 as the jacket pipe 12 shown in FIG. 1.

The suction pipe 2 is connected to the surroundings by means of the suction lines 31, via the suction openings 32 on the outer surface of the jacket pipe 30.

A suction opening 22, as well as chamber 20 with nozzles 60, are located at the bottom of the suction pipe 2, as is also the case in the embodiment in FIG. 1.

A slidable collar 33, provided with openings 34, is arranged on the outside of the jacket pipe 30. The collar 33 is slidable in the longitudinal direction of the jacket pipe 30 by means of a hydraulic piston-cylinder device, only the piston rod 35 of which can be seen.

In the position shown in FIG. 5*a*, the suction effect takes place via the middle set of suction lines 31.

In the position shown in FIG. 5*b*, the collar 33 has been moved upwards. The middle suction openings 32 are now closed off, whilst the lower suction openings 32 are exposed. The upper set of suction lines 31 can be exposed in the same way by moving the collar a suitable distance downwards.

In the variant in FIG. 6, a jacket pipe 38 and a central core 37 are shown. The core 37 has a lower set of openings 39, four of which are evenly spaced over the circumference, as well as a top set of openings 40. Four suction openings 41 have also been made in the jacket pipe 38. In the variant shown in FIG. 6, the openings 39 and 40 are closed off via the jacket pipe 38. The suction effect takes place via the suction openings 41 in the lower telescopic section. Suction openings 41 are in connection with the telescopic suction pipe 62.

By moving the jacket pipe 38 upwards, in such a way that its openings 41 come to lie opposite the openings 39 in the upper telescopic section, the suction effect takes place via said openings. By moving the jacket pipe 38 further upwards, the suction effect can be obtained via the openings 40.

The jacket pipe 38 can be moved up and down by means of a hydraulic piston-cylinder device, the piston rod 32 of which can be seen in FIG. 6.

We claim:

1. An installation for sucking material from a bed of a body of water, comprising:

a housing with a pump therein;

means for removal of the material sucked from a bed of a body of water;

a suction pipe supported by said housing in a fixed angular relationship and having a suction opening connected to said pump and to said means for removal, said suction opening for being located at least two different distances from said housing, said suction pipe extending toward the bed of the body of water and having a supporting face for supporting the installation on the bed, wherein said suction pipe comprises a first and a second telescopic suction pipe section, and further comprising a jacket pipe that is slidable relative to said housing, said second telescopic suction pipe section being fixed within said jacket pipe.

2. The installation of claim 1, further comprising guide means for guiding said second telescopic pipe section within said jacket pipe so that said first and second telescopic pipe sections are movable between a non-overlapping position in which said telescopic pipe sections do not overlap to expose a first opening that is said suction opening, and an overlapping position in which said telescopic pipe sections overlap to close said first opening to permit a second opening at a distal end of said suction pipe to be said suction opening.

3. The installation of claim 2, wherein said guide means comprises a centering ring in said jacket pipe and spaced from said second telescopic pipe section, said centering ring surrounding and being slidable over said first telescopic pipe section.

4. The installation of 1, said suction opening comprising at least one opening that extends radially from said second telescopic suction pipe through said jacket pipe.

5. The installation of 1, wherein said jacket pipe comprises a partition to which said second telescopic suction pipe is fixed, and wherein said jacket pipe comprises a circumferential opening above said partition.

6. The installation of 1, wherein said housing comprises a central core within which said jacket pipe is slidably accommodated.

7. The installation of 6, further comprising a piston-cylinder device for sliding'said jacket pipe.

8. The installation of 6, wherein said central core and said jacket pipe each comprise at least one circumferential ferential opening that are alignable with each other.

9. The installation of 8, wherein said central core comprises at least two said circumferential openings that are at different distances from said housing.

10. The installation of 8, wherein said central core comprises at least two said circumferential openings that are at the same distance from said housing.

11. The installation of claim 1, wherein said housing comprises an opening and a removable lid for closing said opening, said central core extending to o said opening.

12. The installation of claim 1, further comprising an elbow pipe in said core for connecting said first telescopic suction pipe to said pump through a wall of said core.

13. An installation for sucking material from a bed of a body of water, comprising:

a housing with a pump therein;

means for removal of the material sucked from a bed of a body of water;

a suction pipe supported by said housing in a fixed angular relationship and having a suction opening connected to said pump and to said means for removal, said suction opening for being located at least two different distances from said housing, said suction pipe extending toward the bed of the body of water and having a supporting face for supporting the installation on the bed, wherein said suction pipe comprises two longitudinally spaced apart openings that are selectable to be said suction opening.

14. The installation of claim 13, further comprising a jacket pipe surrounding said suction pipe, said two spaced apart openings opening into said jacket pipe.

15. The installation of claim 14, wherein said jacket pipe comprises an external collar that is longitudinally slidable on said jacket pipe to selectably expose said two spaced apart openings.

16. An installation for sucking material from a bed of a body of water, comprising:

a housing with a pump therein;

means for removal of the material sucked from a bed of a body of water;

a suction pipe supported by said housing in a fixed angular relationship and having a suction opening connected to said pump and to said means for removal, said suction opening for being located at least two different distances from said housing, said suction pipe extending toward the bed of the body of water and having a supporting face for supporting the installation on the bed, wherein said housing comprises ballast means for sinking the installation. slidable on said jacket pipe to selectably expose said two spaced apart openings.

17. The installation of claim 16, wherein said ballast means comprises a ballast chamber for holding water and a second chamber for being pressurized, said ballast chamber being connected to said second chamber so that said ballast chamber can be emptied by pressure from said second chamber.

18. An installation for sucking material from a bed of a body of water, comprising:

a housing with a pump therein;

means for removal of the material sucked from a bed of a body of water; and a suction pipe supported by said housing and connected to said pump and to said means for removal, said suction pipe comprising at least two telescoping members and at least two suction openings each of which are located at different distances from said housing, said suction openings being selectively opened by relative movement of said telescoping members.

19. The installation of claim 18, further comprising a jacket pipe that is slidable relative to said housing, one of said telescoping members being fixed within said jacket pipe remote from said housing and comprising one of said suction openings at a distal end thereof that is within said jacket pipe, the other of said suction openings being in said jacket pipe adjacent the other end of said one telescoping member.

20. The installation of claim 19, further comprising guide means for guiding the other said telescoping member within said jacket pipe so that said two telescoping members are movable between a non-overlapping position in which said telescoping members do not overlap to allow said other suction opening to suck the material, and an overlapping position in which said two telescoping members overlap to close said other suction opening to allow said one suction opening to suck the material.

21. An installation for sucking material from a bed of a body of water, comprising:

a housing with a pump therein;

means for removal of the material sucked from a bed of a body of water; and a suction pipe supported by said housing and connected to said pump and to said means for removal, said suction pipe comprising a first telescoping pipe nearer said housing than a second telescoping pipe that extends from a first end of said first telescoping pipe and that is retractable coaxially with said first telescoping pipe, said second telescoping pipe being spaced from said first end of said first telescoping pipe when said suction pipe is fully extended, said suction pipe further comprising a first suction opening at a distal end of said second telescoping pipe and a second suction opening at said first end of said first telescoping pipe, said second suction opening for sucking the material when said suction pipe is fully extended and not sucking the material when said suction pipe is not fully extended.

* * * * *